US010786990B2

(12) United States Patent
Hamano

(10) Patent No.: US 10,786,990 B2
(45) Date of Patent: Sep. 29, 2020

(54) INK-JET RECORDING APPARATUS

(71) Applicant: Konica Minolta, Inc., Chiyoda-ku, Tokyo (JP)

(72) Inventor: Hikaru Hamano, Saitama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/315,330

(22) PCT Filed: Jun. 21, 2017

(86) PCT No.: PCT/JP2017/022781
§ 371 (c)(1),
(2) Date: Jan. 4, 2019

(87) PCT Pub. No.: WO2018/008397
PCT Pub. Date: Jan. 11, 2018

(65) Prior Publication Data

US 2019/0210369 A1 Jul. 11, 2019

(30) Foreign Application Priority Data

Jul. 4, 2016 (JP) ..... 2016-132329

(51) Int. Cl.
*B41J 2/14* (2006.01)
*B41J 2/16* (2006.01)
(Continued)

(52) U.S. Cl.
CPC ..... *B41J 2/14233* (2013.01); *B41J 2/14209* (2013.01); *B41J 2/1623* (2013.01);
(Continued)

(58) Field of Classification Search
CPC .. B41J 2/14233; B41J 2/14209; B41J 2/1623; B41J 2/18; B41J 2/19
See application file for complete search history.

(56) References Cited

U.S. PATENT DOCUMENTS

2002/0118256 A1* 8/2002 Dixon ..... B41J 2/04 347/65
2007/0211109 A1* 9/2007 Enomoto ..... B41J 2/14233 347/50
(Continued)

FOREIGN PATENT DOCUMENTS

JP 2008200902 A 9/2008
JP 2008254196 A 10/2008
(Continued)

OTHER PUBLICATIONS

PCT International Preliminary Report on Patentability corresponding to Application No. PCT/JP2017/022781; dated Jan. 8, 2019.
(Continued)

*Primary Examiner* — Jason S Uhlenhake
(74) *Attorney, Agent, or Firm* — Cantor Colburn LLP

(57) ABSTRACT

An ink-jet recording apparatus may include an ink-jet head having: individual connection flow channels through which ink can be discharged from pressure chambers; and a common flow channel at which ink from the individual connection flow channels merges, wherein when the ink is ejected, in a nozzle through which the maximum amount of ink per unit time is ejected, the relationship of (Fn/Fi)≤10 is satisfied, Fn representing the amount of ink ejected per unit time from the nozzle, and Fi representing the average flow rate of ink discharged per unit time from the individual connection flow channels, and the relationship of (Rc/Rt)≤10 is satisfied, Rc representing the flow channel resistance of the common flow channel, and Rt representing the synthetic resistance of the individual connection flow channels.

6 Claims, 10 Drawing Sheets

(51) Int. Cl.

| | |
|---|---|
| ***B41J 2/18*** | (2006.01) |
| ***B41J 2/19*** | (2006.01) |
| ***B41J 29/38*** | (2006.01) |

(52) U.S. Cl.

CPC . *B41J 2/18* (2013.01); *B41J 2/19* (2013.01); *B41J 29/38* (2013.01); *B41J 2002/14241* (2013.01); *B41J 2002/14306* (2013.01); *B41J 2002/14362* (2013.01); *B41J 2002/14419* (2013.01); *B41J 2002/14467* (2013.01); *B41J 2002/14491* (2013.01); *B41J 2202/07* (2013.01); *B41J 2202/12* (2013.01); *B41J 2202/18* (2013.01); *B41J 2202/20* (2013.01)

(56) References Cited

U.S. PATENT DOCUMENTS

| | | | |
|---|---|---|---|
| 2008/0198208 | A1 | 8/2008 | Kyoso et al. |
| 2008/0238980 | A1 | 10/2008 | Nagashima et al. |

FOREIGN PATENT DOCUMENTS

| | | | |
|---|---|---|---|
| JP | 2008290292 | A | 12/2008 |
| JP | 2012071485 | A | 4/2012 |
| JP | 5385975 | B2 | 1/2014 |
| JP | 5590321 | B2 | 9/2014 |
| WO | 2009143362 | A1 | 11/2009 |
| WO | 2014021812 | A1 | 2/2014 |
| WO | 2015199191 | A1 | 12/2015 |

OTHER PUBLICATIONS

Extended European Search Report corresponding to Application No. 17824004.0-1019/3480016 PCT/JP2017022781; dated May 17, 2019.

International Search Report of the International Searching Authority for PCT/JP2017/022781; dated Sep. 19, 2017.

SIPO First Office Action corresponding to CN201780041932.2 dated Dec. 24, 2019.

* cited by examiner

INK-JET RECORDING APPARATUS

CROSS REFERENCE TO RELATED APPLICATIONS

This is the U.S. national stage of application No. PCT/JP2017/022781, filed on Jun. 21, 2017. Priority under 35 U.S.C. § 119(a) and 35 U.S.C. § 365(b) is claimed from Japanese Application No. 2016-132329, filed Jul. 4, 2016, the disclosures of which are incorporated herein by reference.

TECHNOLOGICAL FIELD

The present invention relates to an inkjet recording apparatus.

DESCRIPTION OF THE RELATED ART

There has been conventionally known an inkjet recording apparatus which ejections ink stored in a pressure chamber through nozzles provided in an inkjet head to form an image on a recording medium.

Such an inkjet recording apparatus causes, in some cases, a problem of nozzle clogging due to air bubbles generated in the inkjet head or an entering foreign material, which may result in ejection defect. Some types of ink become thick near the nozzles due to sedimentation of ink particles, precluding a stable ink ejection if the inkjet recording apparatus is left unused for a long time.

To cope with these problems, there are known inkjet heads provided with channels for circulating ink in the pressure chambers and can discharge air bubbles and foreign materials in the heads together with ink out of the inkjet heads (Patent Documents 1 and 2).

For example, each of Patent Documents 1 and 2 discloses an inkjet head that includes individual communication flow channels (circulating channels), a common flow channel, and an ink discharge channel inside the head, the individual communication flow channels enabling ejection of ink from each pressure chamber, the common flow channel allowing the individual communication flow channels to join, and the ink discharge channel being able to discharge ink from the common flow channel.

PRIOR ART DOCUMENTS

Patent Document

Patent Document 1: Japanese Patent No. 5385975
Patent Document 2: Japanese Patent No. 5590321

SUMMARY

Problems to be Solved by the Invention

Nowadays, a high-density array of nozzles is required to reduce the size of the inkjet head and enhance the resolution of the image. The present inventor has found that a high-density array of nozzles in an inkjet head provided with conventional circulating channels (individual communication flow channels) results in a significant variance in the flow amount of circulating ink among the individual communication flow channels.

An increased flow amount of circulating ink can effectively expel air bubbles or foreign materials from the pressure chambers, but reduces the ejection energy efficiency, which results in a reduced ejection rate or a reduced amount of an ink droplet. The variance in the flow amount of circulating ink among the individual communication flow channels causes a variance in ink ejection performance among the nozzles.

The present invention has been made in consideration of such problems, and an object of the present invention is to provide an inkjet recording apparatus that can effectively expel air bubbles or foreign materials in the head chip together with ink while reducing a variance in ink ejection performance.

Means For Solving the Problem

In order to achieve the above object, an inkjet recording apparatus may include: an inkjet head that includes: a plurality of nozzles which eject ink, a plurality of pressure chambers which are provided in communication with the respective nozzles and store ink to be ejected from the nozzles, a plurality of pressure generators which are provided so as to correspond to the respective pressure chambers and apply pressure to ink in the pressure chambers, a plurality of individual communication flow channels which are provided so as to branch from the respective pressure chambers or from respective communication channels between the pressure chambers and the nozzles, and from which ink in the pressure chambers is discharged, and a common flow channel which is connected to the individual communication flow channels and at which ink discharged from the individual communication flow channels merges with each other; and an ink feeder which generates a circulatory flow of ink from the pressure chambers to the individual communication flow channels, and a relation between Fn and Fi when ink is ejected from the nozzles satisfies the following expression (1), Fn being an ink amount per unit time which is ejected from a nozzle that ejects a maximum amount of ink per unit time among all the nozzles provided in the inkjet head, and Fi being an average ink flow amount per unit time which is discharged from the individual communication flow channels to the common flow channel, and a relation between Rc and Rt satisfies the following expression (2), Rc being a flow channel resistance of the common flow channel and Rt being a combined resistance of the individual communication flow channels connected to the common flow channel.

$$(Fn/Fi) \leq 10 \qquad \text{Expression (1):}$$

$$(Rc/Rt) \leq 10 \qquad \text{Expression (2):}$$

In at least an embodiment, the flow channel resistance of the common flow channel increases toward an exit of the common flow channel.

In at least an embodiment, among the individual communication flow channels connected to the common flow channel, the individual communication flow channel connected to a position closer to an exit of the common flow channel has a larger flow channel resistance.

In at least an embodiment, one exit of the common flow channel is provided at each end of an arrangement direction of the nozzles.

At least an embodiment may further include a damper which is provided so as to face an inner surface of the common flow channel and changes a volume of the flow channel by elastic deformation under pressure.

In at least an embodiment, the damper is formed by a nozzle substrate in which the nozzles are formed.

In at least an embodiment, a manifold which stores ink to be fed to the pressure chambers is provided above the pressure chambers.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Advantageous Effects of Invention

Hereinafter, one or more embodiments of the present invention will be described with reference to the drawings. However, the scope of the invention is not limited to the disclosed embodiments.

The present invention can effectively expel air bubbles or foreign materials in the head together with ink while reducing a variance in ink ejection performance.

Figure 2:
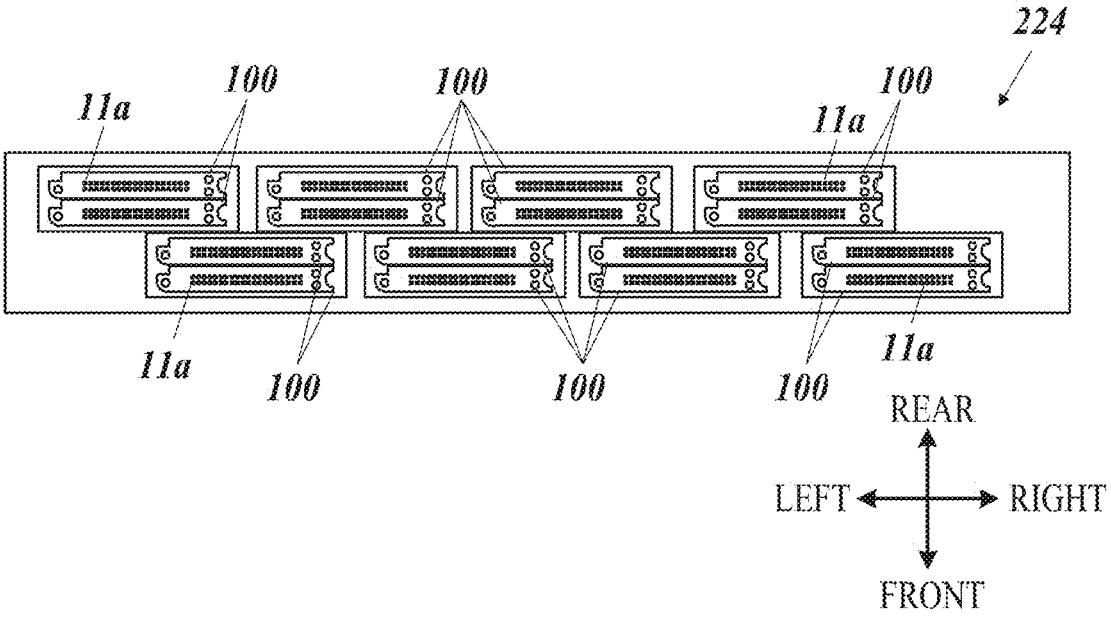
FIG. 2 a bottom view of a head unit

A preferred embodiment of the present invention will now be described with reference to the accompanying drawings. The embodiments shown in the drawings should not be construed to limit the scope of the present invention. For the convenience of explanation, this specification defines a lateral direction, a longitudinal direction, and a vertical direction as follows: The lateral direction is a print width direction along which nozzles 11*a* are disposed in an inkjet head 100 as shown in FIG. 2; the longitudinal direction is a transfer direction of a recording medium under the nozzles 11*a*; and the vertical direction is perpendicular to both the lateral direction and the longitudinal direction. The arrows depicted in the channels in the drawings indicate the direction of flowing ink.

[Inkjet Recording Apparatus]

Figure 1:
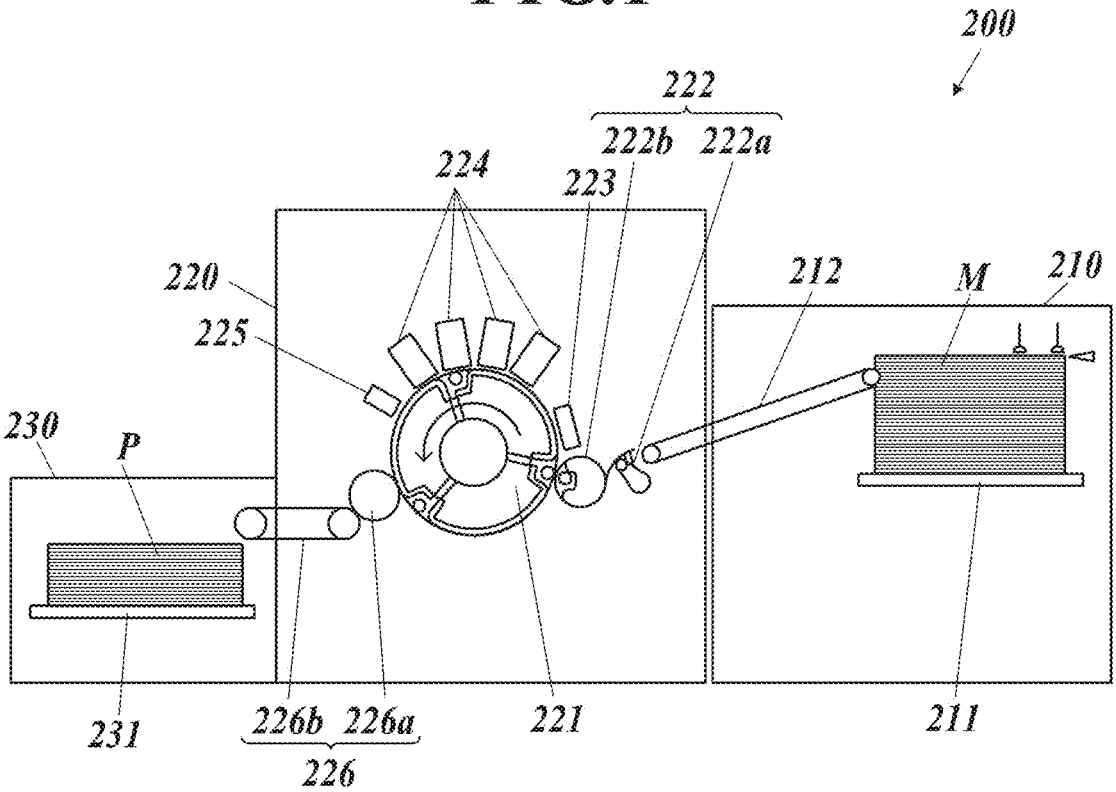
FIG. 1 an overview of an inkjet recording apparatus
Figure 10:
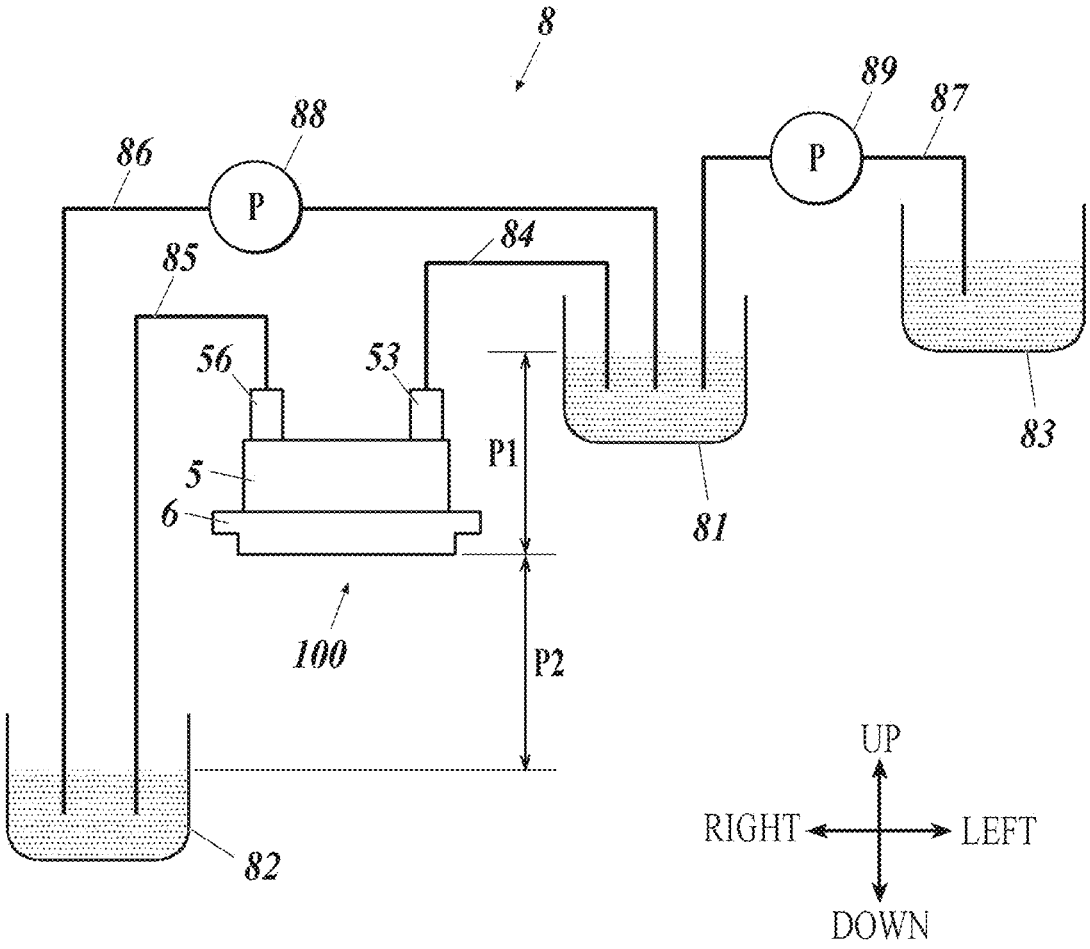
FIG. 10 a schematic illustration of an ink circulator system

With reference to FIG. 1, the inkjet recording apparatus 200 includes a sheet feeder 210, an image recorder 220, a sheet receiver 230, and an ink circulator system 8 that functions as an ink feeder (see FIG. 10). The inkjet recording apparatus 200 transfers a recording medium M from the sheet feeder 210 to the image recorder 220, forms an image on the recording medium M at the image recorder 220, and transfers the recorded recording medium M to the sheet receiver 230.

The sheet feeder 210 includes a sheet tray 211 storing the recording medium M and a medium carrier 212 conveying the recording medium M from the sheet tray 211 to the image recorder 220. The medium carrier 212 is equipped with a belt loop. The inner face of the belt loop is supported by two rollers. The rotation of the roller causes recording medium M carried on the belt loop to be transferred from the sheet tray 211 to the image recorder 220.

The image recorder 220 includes a transfer drum 221, a relay unit 222, a heater 223, a head unit 224, a fixer 225, and a delivery unit 226.

The transfer drum 221 has a cylindrical transfer face on which the recording medium M is carried. The transfer drum 221 rotates in the direction shown in FIG. 1, while holding the recording medium M on the transfer face, to transfer the recording medium M along with the transfer face. The transfer drum 221 includes claws and an air sucking unit (not shown). The claws fix the recording medium M at its ends, and the air sucking unit attracts the recording medium M to the transfer face. Thereby, the transfer drum 221 retains the recording medium M on the transfer face.

The relay unit 222 is disposed between the medium carrier 212 of the sheet feeder 210 and the transfer drum 221. The relay unit 222 receives one end of the recording medium M transferred on the medium carrier 212 at a swing arm 222*a* and delivers the recording medium M to the transfer drum 221 via the delivery drum 222*b*.

The heater 223 is disposed between the delivery drum 222*b* and the head units 224. The heater 223 heats the recording medium M on the transfer drum 221 to a predetermined temperature. The heater 223 includes, for example, an infrared heater. The infrared heater is energized in accordance with control signals sent from a controller (not shown) to cause the heater to generate heat.

The head units 224 ejects ink onto the recording medium M on the transfer drum 221 in accordance with image data at an appropriate timing in response to the rotation of the transfer drum 221 to record an image. The head units 224 are disposed such that ink ejecting faces face the transfer drum 221 with a predetermined gap. The inkjet recording apparatus 200 according to this embodiment includes four head units 224 corresponding to four colors of Y (yellow), M (magenta), C (cyan), and K (black). These head units 224 are disposed at predetermined intervals in the order of Y, M, C, and K from the upstream side in the transfer direction of the recording medium M.

Each head unit 224 has pairs of inkjet heads 100 adjacent to each other in the longitudinal direction. These pairs are disposed, for example, in a staggered manner in the longitudinal direction, as shown in FIG. 2. The head units 224 are fixed relative to the rotational axis of the transfer drum 221 during image recording. In other words, the inkjet recording apparatus 200 records an image by a one-path drawing scheme involving the use of a line head.

The fixer 225 includes a light emitter extending across the X direction of the transfer drum 221. The fixer 225 irradiates the recording medium M on the transfer drum 221 with energy rays, such as ultraviolet rays, from the light emitter to cure and fix the ink ejected on the recording medium M. The light emitter of the fixer 225 faces the transfer face downstream of the head units 224 and upstream of a delivery drum 226*a* of the delivery unit 226 in the transfer direction.

The delivery unit 226 includes an belt loop 226*b* and a cylindrical delivery drum 226*a*. The inner face of loop shape belt of the belt loop 226*b* is supported by two rollers. The delivery drum 226*a* delivers the recording medium M from the transfer drum 221 to the belt loop 226*b*. The delivery unit 226 receives the recording medium M from the transfer drum 221 onto the belt loop 226*b* at the delivery drum 226*a*, and transfers the recording medium M on the belt loop 226*b* to the sheet receiver 230.

The sheet receiver 230 includes a flat sheet receiving tray 231 on which the recording medium P transferred from the image recorder 220 with the delivery unit 226.

[Inkjet Head]

Figure 3A:
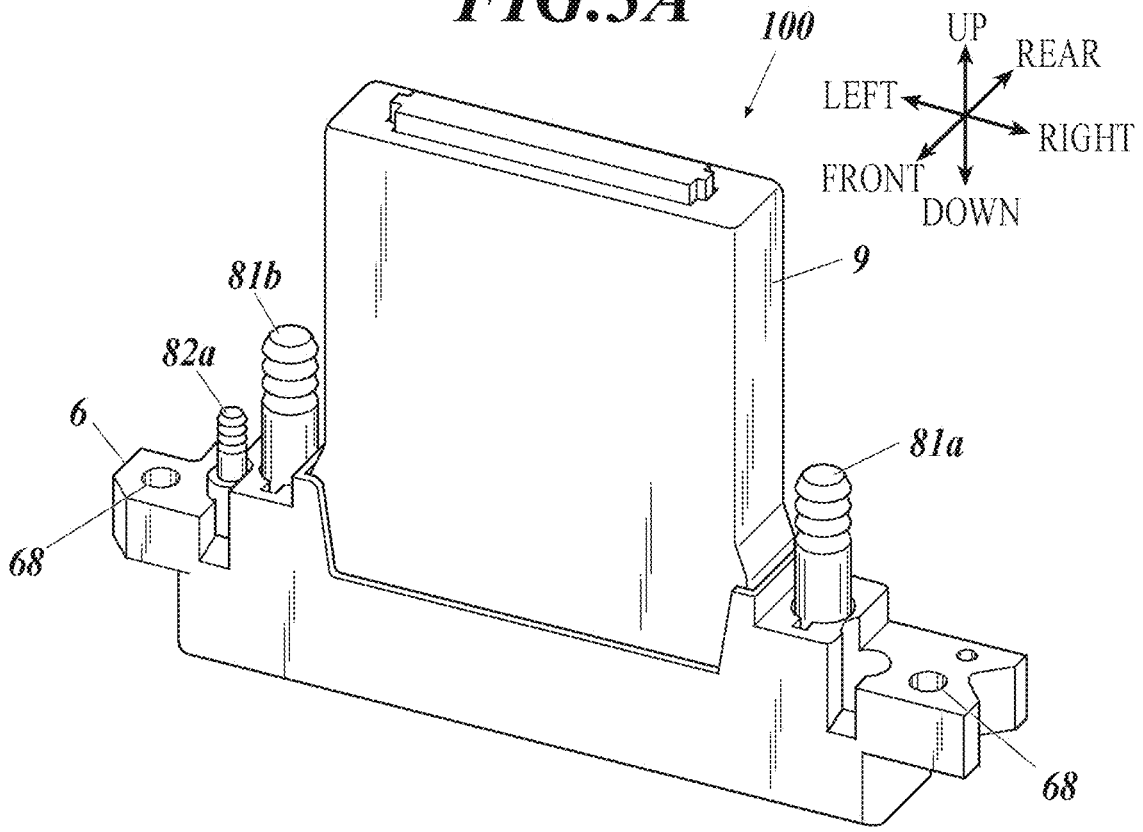
FIG. 3A a perspective view of the inkjet head
Figure 3B:
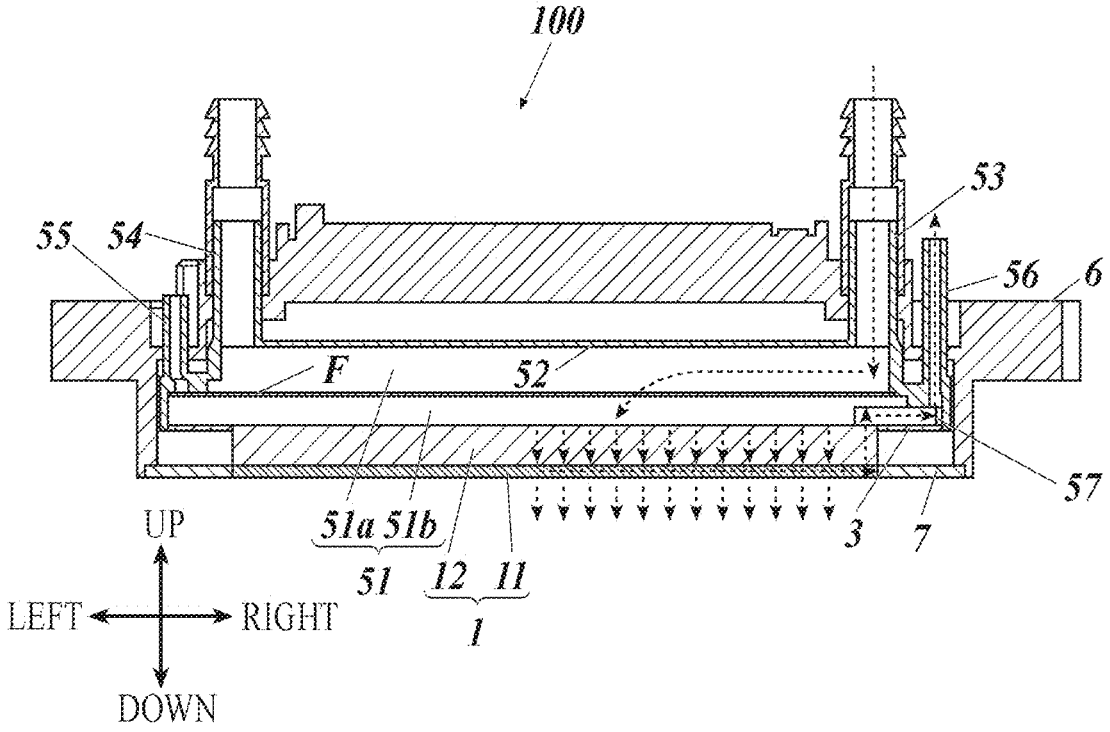
FIG. 3B a cross-sectional view of the inkjet head
Figure 4:
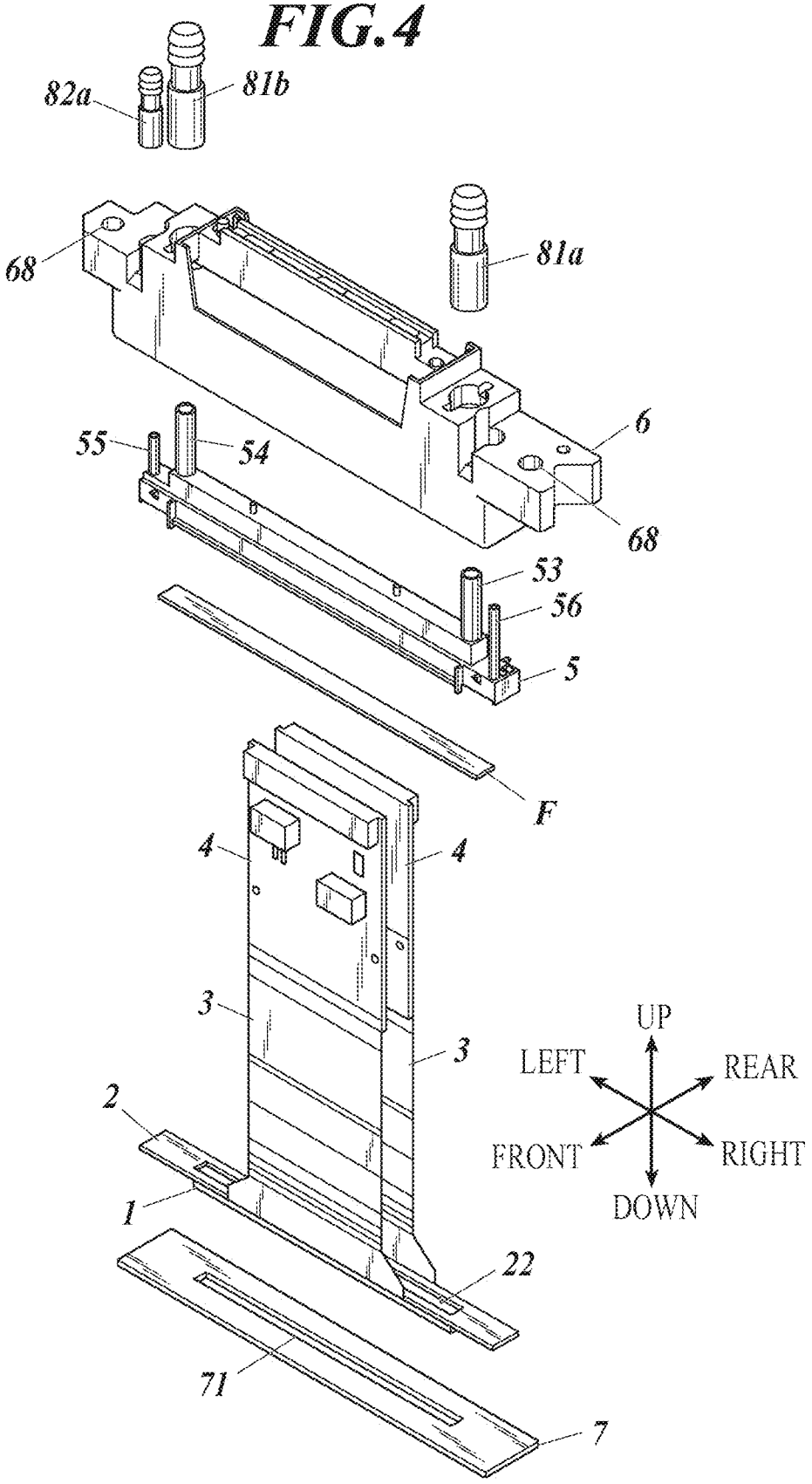
FIG. 4 an exploded perspective view of the inkjet head

With reference to FIGS. 3A, 3B, and FIG. 4, the inkjet head 100 according to this embodiment includes a head chip 1, a wiring substrate 2 on which the head chip 1 is disposed, a driving circuit substrate 4 which is connected to the wiring substrate 2 via a flexible substrate 3, a manifold 5 which contains ink to be fed to pressure chambers 13A in the head chip 1, a housing 6 accommodating the manifold 5, a cap receiver 7 mounted so as to block an opening in the bottom face of the housing 6, and a cover 9 mounted on the housing 6 (FIG. 3A, FIG. 3B, and FIG. 4).

The manifold 5 is not shown in FIG. 3A. The cover 9 is not shown in FIG. 3B and FIG. 4.

In the head chip 1 according this embodiment, the nozzles 11*a* are disposed in two rows. Alternatively, the nozzles 11*a* may be disposed in any number of rows or in any arrangement, for example, in one row or three or more rows.

The head chip 1 is a substantially rectangular column extending in the lateral direction, and includes a pressure chamber substrate 12 and a nozzle substrate 11.

Figure 5:
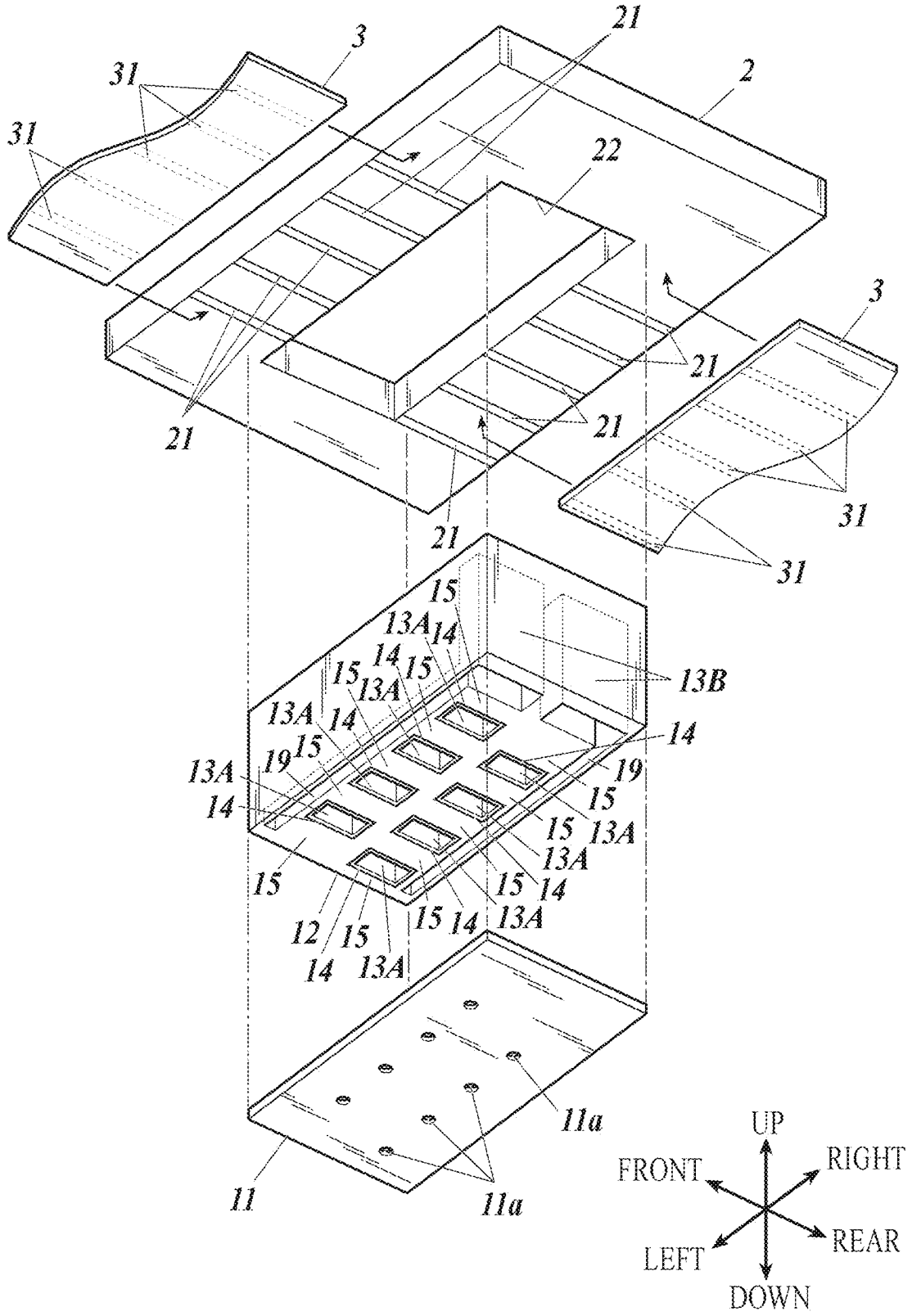
FIG. 5 a schematic exploded perspective view illustrating a head chip and a wiring substrate FIG. 6 a bottom perspective view for explaining ink flow inside the head chip FIG. 7 a cross-sectional view taken along the line VII-VII in FIG. 6

The pressure chamber substrate 12 is provided with pressure chambers 13A, discharge flow channels 13B, and common flow channels 19 (See FIG. 5).

The pressure chambers 13A are separated by partitions 15 as a pressure generator composed of a piezoelectric material, and contain ink to be ejected through nozzles 11*a*. Each pressure chamber 13A is provided with a driving electrode 14 on the inner surface thereof to drive the partition 15 between adjacent pressure chambers 13A. A voltage applied to the driving electrodes 14 causes repeated shear-mode displacements of the partition 15 between the adjacent pressure chambers 13A, which pressurizes the inks in the respective pressure chambers 13A.

Each pressure chamber 13A has a substantially rectangular cross section, extends in the vertical direction, and has an inlet on the top face of the pressure chamber substrate 12 and an outlet on the bottom thereof. The pressure chambers 13A are disposed in parallel in the lateral direction and in two rows in the longitudinal direction.

Similar to the pressure chambers 13A, the discharge flow channels 13B are separated by the partitions 15 and discharges the ink the outside of the inkjet head 100 toward the top, which is opposite the nozzle substrate 11. The discharge flow channels 13B extend vertically and have outlets on the top face and inlets on the bottom face of the pressure chamber substrate 12. Two discharge flow channels 13B are disposed near the right end of the head chip 1 in parallel with the pressure chambers 13A. Each discharge flow channels 13B having a volume larger than that of each pressure chamber 13A can enhance ink discharge efficiency.

Figure 6:
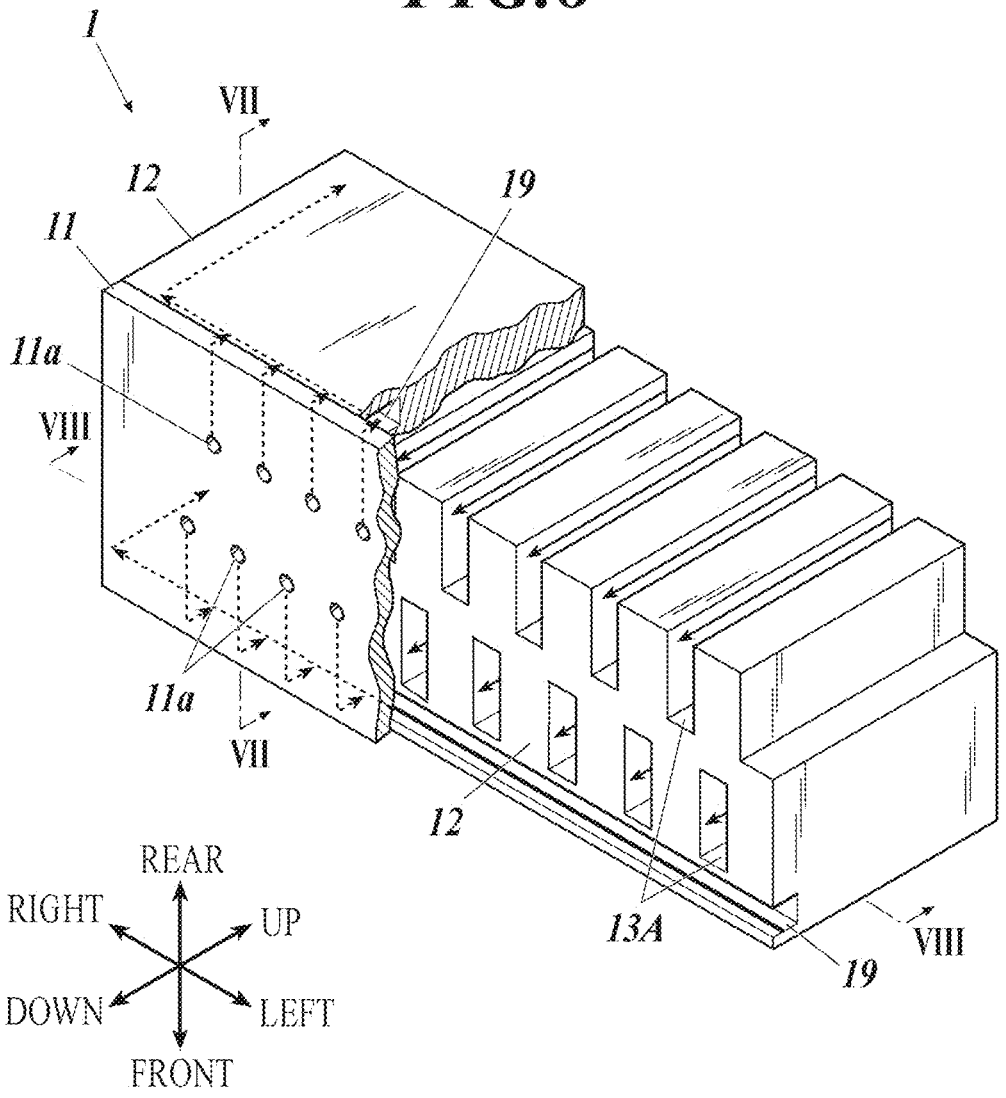
Figure 7:
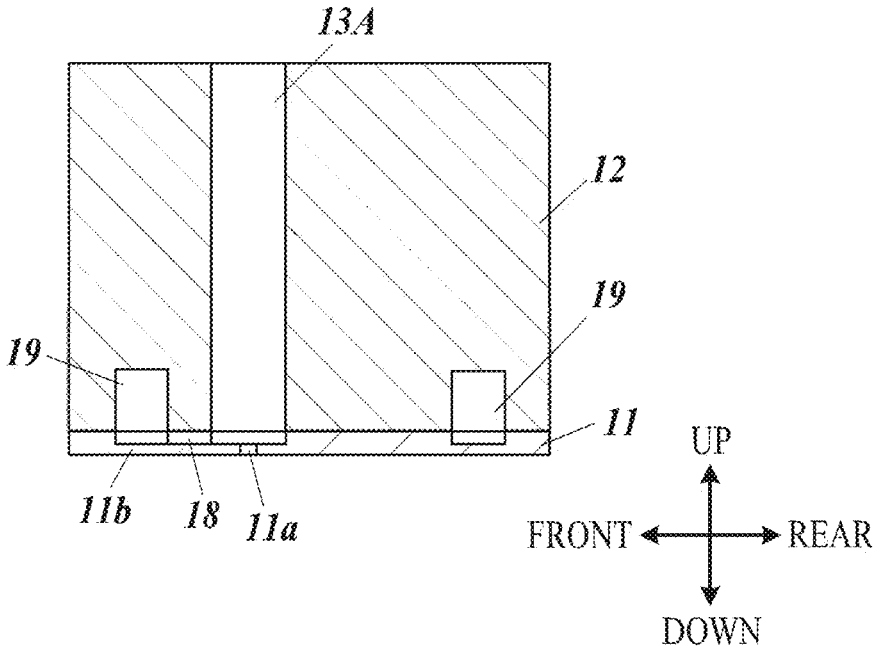

The common flow channels 19 are provided in the lower portions of the pressure chamber substrate 12, the individual communication flow channels 18 communicating with the pressure chambers 13A are connected to the common flow channels 19, and inks flowing from the individual communication flow channels 18 merge at the common flow channels 19 (See FIG. 6 and FIG. 7). The common flow channels 19 are disposed in parallel with each other in the lateral direction for each nozzle row, and are in communication with the respective discharge flow channels 13B near their right ends. The common flow channels 19 provided in the pressure chamber substrate 12 can expand the volume of flow channel and increase the amount of ink circulated within the head chip 1, effectively discharging air bubbles.

Figure 8:
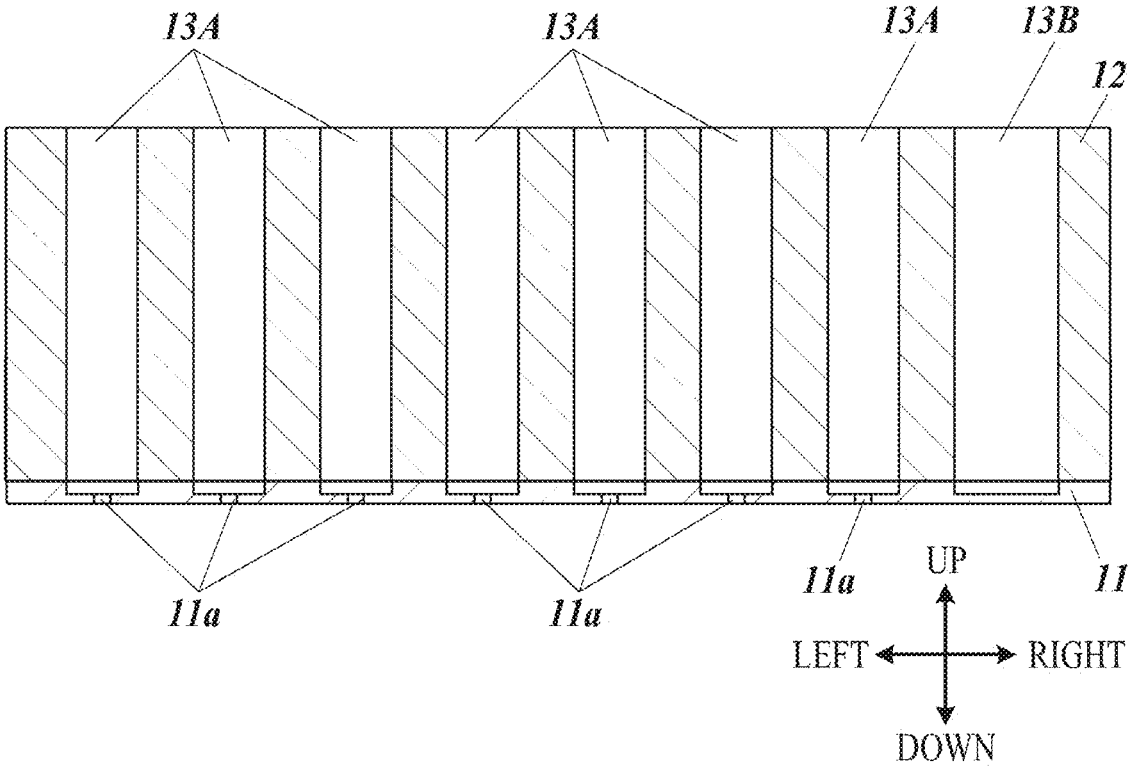
FIG. 8 a cross-sectional view taken along the line VIII-VIII in FIG. 6

The nozzle substrate 11 includes the nozzles 11*a* and the individual communication flow channels 18. The nozzle substrate 11 also include the pressure chambers 13A, the discharge flow channels 13B, and the common flow channels 19 at the positions corresponding to those of the lower portions of the pressure chambers 13A, the discharge flow channels 13B, and the common flow channels 19 provided in the pressure chamber substrate 12, so as to have identical cross-sectional shapes with those of the respective chambers and channels (See FIG. 7 and FIG. 8). In other words, the nozzle substrate 11 is disposed to block the lower ends of the pressure chambers 13A, the discharge flow channels 13B, and the common flow channels 19. These channels are disposed across the pressure chamber substrate 12 and the nozzle substrate 11.

The common flow channels 19 are formed in the nozzle substrate 11. The lower portions of the common flow channels 19 are so thin that they undergo slight elastic deformation by pressure, and thus can vary the volume of flow channel and function as a damper 11*b*.

The nozzle substrate 11 is fabricated by, for example, laser beam machining of a polyamide plate or etching of a silicon plate.

Each nozzle 11*a* extends through the nozzle substrate 11 under the corresponding pressure chamber 13A in the thickness or vertical direction to eject the ink stored in the pressure chamber 13A. The nozzles 11*a* according to this embodiment are disposed in the lateral direction and in two rows in the longitudinal direction.

Figure 9A:
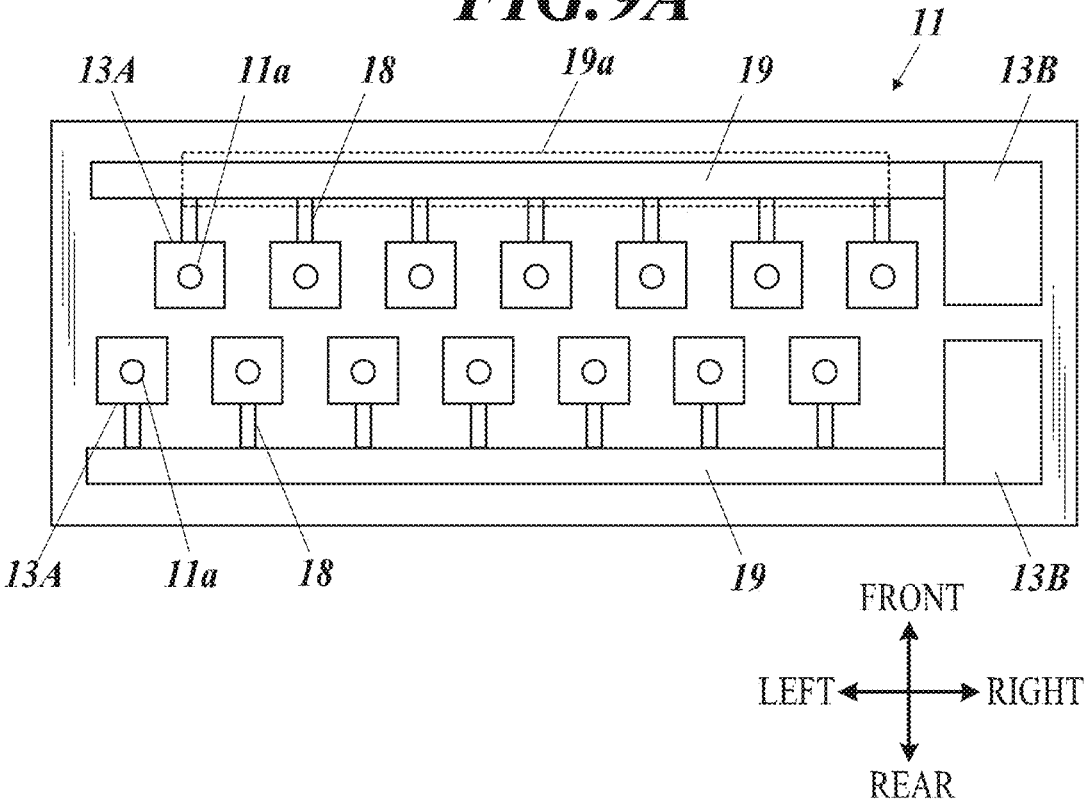
FIG. 9A a plan view of a nozzle substrate

Each individual communication flow channel 18 is provided in the upper portion of the nozzle substrate 11 so as to communicate with the corresponding pressure chamber 13A and the corresponding common flow channel 19 (FIG. 7 and FIG. 9A). The individual communication flow channel 18 may be disposed in the pressure chamber substrate 12, not the nozzle substrate 11, or across the nozzle substrate 11 and the pressure chamber substrate 12 as long as the individual communication flow channel 18 communicates with the pressure chamber 13A and the common flow channel 19.

With reference to FIG. 4 and FIG. 5, the wiring substrate 2 is provided on the top face of the head chip 1. Two flexible substrates 3 are provided along the edges, extending in the longitudinal direction, of the wiring substrate 2 and connected to the driving circuit substrates 4.

The wiring substrate 2 is a substantially rectangular plate extending in the lateral direction, and has an opening 22 in the substantially central portion. The wiring substrate 2 has greater widths both in the lateral and longitudinal directions than those of the head chip 1.

The opening 22 has a substantially rectangular shape extending in the lateral direction and exposes the inlets of the pressure chambers 13A and the outlets of the discharge flow channel 13B in the head chip 1 to the upper side while the head chip 1 is mounted on the wiring substrate 2. A predetermined number of electrode portions 21 are provided along the edges extending in the longitudinal direction of the opening 22. The electrode portions 21 are connected to electrodes (not shown) extending upward from the driving electrodes 14 in the head chip 1 to the top face of the head chip 1 (FIG. 5).

With reference to FIG. 5, the flexible substrates 3 include wirings 31 that electrically connect the driving circuit substrates 4 to the electrode portions 21 of the wiring substrate 2. This allows signals from the driving circuit substrates 4 to be conveyed to the driving electrodes 14 in the respective pressure chambers 13A in the head chip 1 through the wirings 31 and the electrode portions 21.

The lower portion of the manifold 5 is bonded to the outer edges of the wiring substrate 2. In other words, the manifold 5 is disposed on the side of the inlets (on the upper side) of the pressure chambers 13A in the head chip 1, and is connected to the head chip 1 via the wiring substrate 2.

The manifold 5 is made of a resin and disposed above the pressure chambers 13A in the head chip 1, and stores ink to flow into the pressure chambers 13A. With reference to FIG. 3B, the manifold 5 extends in the lateral direction, and includes a hollow body 52 constituting an ink storage 51 and first to fourth ink ports 53 to 56 constituting an ink channel. The ink storage 51 consists of two sections, which are an upper first ink chamber 51*a* and a lower second ink chamber 51*b*, separated by a filter F for removing debris in the ink.

The first ink port 53 is in communication with the upper right portion of the first ink chamber 51*a* and is used to introduce ink into the ink storage 51. The first ink port 53 has a first joint 81*a* inserted into the tip.

The second ink port 54 is in communication with the upper left portion of the first ink chamber 51*a* and is used to expel air bubbles from the first ink chamber 51*a*. The second ink port 54 has a second joint 81*b* inserted into the tip.

The third ink port 55 is in communication with the upper left portion of the second ink chamber 51*b* and is used to expel air bubbles from the second ink chamber 51*b*. The third ink port 55 has a third joint 82*a* inserted into the tip.

The fourth ink port 56 is in communication with a discharge ink chamber 57 which is in communication with the discharge flow channels 13B in the head chip 1. This configuration allows the ink discharged from the head chip 1 to be discharged to the exterior of the inkjet head 100 through the fourth ink port 56.

The housing 6 is made of, for example, aluminum by die casting and extends in the lateral direction. The housing 6 accommodates the manifold 5 including the head chip 1, the wiring substrate 2, and the flexible substrates 3, and has a bottom opening. The housing 6 has mount holes 68 at its two ends for mounting the housing 6 on the body of the printer.

The cap receiver 7 has a nozzle opening 71 extending in the lateral direction in its substantially central region. The cap receiver 7 is mounted to block the bottom opening of the housing 6 such that the nozzle substrate 11 is exposed through the nozzle opening 71.

[Design of Flow Channels in the Inkjet Head]

The inkjet heads 100 provided in the inkjet recording apparatus 200 according to this embodiment are designed such that a relation between Fn and Fi when ink is ejected from the nozzles 11*a* satisfies the following expression (1), Fn being an ink amount per unit time which is ejected from a nozzle 11*a* that ejects a maximum amount of ink per unit time among all the nozzles 11*a* provided in the inkjet head 100, and Fi being an average ink flow amount per unit time which is discharged from the individual communication flow channels 18 to the common flow channels 19.

$$(Fn/Fi) \leq 10 \qquad \text{Expression (1):}$$

In this specification, "an ink amount Fn per unit time which is ejected from a nozzle 11*a* that ejects a maximum amount of ink per unit time among all the nozzles 11*a* provided in the inkjet head 100" is determined by calculating the amount (L/s) of ink ejected per unit time (second) for each of all the nozzles 11*a* provided in the inkjet head 100 and selecting the largest one.

The amount (L/s) of ink ejected per unit time (second) from each nozzle 11*a* can be determined as the product of drive frequency (Hz) and the amount (L) of ink droplets ejected. During ejection of ink from the inkjet head 100 provided with multiple nozzles 11*a* (for example, 256 nozzles 11*a*), at least one nozzle 11*a* ejections ink at the maximum drive frequency (Hz) in most cases. Thus, Fn may be determined as the product of the maximum drive frequency (Hz) and the amount of ink droplets ejected (L).

In this specification, the "average ink flow amount Fi per unit time which is discharged from the individual communication flow channels 18 to the common flow channels 19" is an averaged flow amount (L/s) per unit time (second) of ink discharged from individual communication flow channels 18 in the inkjet head 100 to the common flow channels 19. In details, the averaged flow amount (L/s) per unit time (second) can be determined by dividing the flow amount (L/s) per unit time (second) of ink discharged from the common flow channels 19 to the outside of the inkjet head 100 by the number of the individual communication flow channels 18.

Satisfaction of Expression (1) means that ink in at least one tenth of Fn (L/s) is discharged from the individual communication flow channels 18 to the common flow channels 19.

The inkjet head 100 according to this embodiment is accordingly designed to increase the flow amount of ink discharged from the individual communication flow channels 18 per unit time. This configuration allows air bubbles in the inkjet head to be expelled effectively together with ink. The inventor has verified the effect with the example 1 described below.

Fi (L/s) can be adjusted, as needed, by adjustment of the flow channel design and/or ink pressure within the inkjet head. For example, an increased cross-sectional area of each individual communication flow channel 18 or an increased amount of ink introduced from the ink circulator system 8 can increase Fi (L/s).

In this embodiment, the ratio Fn/Fi need to be 10 or less so that the average flow amount Fi is at least one tenth of the amount Fn. However, an increase in the average flow amount Fi by increasing the cross-sectional area of each individual communication flow channel 18 causes dissipation to the individual communication flow channel 18 of the energy required for ejection of ink droplets from the corresponding nozzle 11*a* generated at the corresponding pressure chamber 13A, resulting in a reduction in ejection energy efficiency. This results in a reduced ejection rate or a reduced amount of an ink droplet. To prevent this phenomenon, the ratio Fn/Fi should preferably be 1 or more.

The inkjet head 100 is designed such that a relation between Rc and Rt satisfies the following expression (2), Rc being a flow channel resistance of the common flow channel 19 and Rt being a combined resistance of the individual communication flow channels 18 connected to the common flow channel 19.

$$(Rc/Rt) \leq 10 \qquad \text{Expression (2):}$$

In this specification, as shown in FIG. 9A, the "flow channel resistance Rc of the common flow channel 19" is defined as the flow channel resistance of a flow channel portion 19*a* of the common flow channel 19 connected to the individual communication flow channels 18. In detail, the "flow channel resistance Rc of the common flow channel 19" refers to the flow channel resistance of the flow channel portion from the connected portion of the leftmost individual communication flow channel 18 to the connected portion of the rightmost individual communication flow channel 18 in the direction in which ink flows through the common flow channel 19 (the right direction), as shown in FIG. 9A.

The inkjet head 100, which meets Expression (2), can effectively expel air bubbles or foreign materials in the inkjet head together with ink, while reducing a variance in ink ejection performance. The inventor has verified the effect with the example 2 described below.

The inkjet head 100 configured to have a high flow amount of ink discharged from the individual communication flow channels 18 satisfying Expression (1) has low ink ejection energy efficiency, which results in a reduced ejection rate or a reduced amount of ink droplets. A variance in the amount of ink droplets discharged from each individual communication flow channel 18 results in a variance in ink ejection performance among the nozzles 11*a*.

A configuration of the common flow channels 19 and the individual communication flow channels 18 satisfying Expression (2) can reduce a variance in ink ejection performance among the nozzles 11*a*. In other words, the inventor has obtained an effect of effectively expelling air bubbles or foreign materials in the inkjet head together with ink, while reducing a variance in ink ejection performance among the nozzles 11*a*. The cause of this can be considered that there can be an influence of the flow channel resistance of the common flow channel 19 depending on the position where the individual communication flow channel 18 is connected to the common flow channel 19, leading to different easiness of ink flow from the individual communication flow channel 18 to the common flow channel 19. For example, even if the individual communication flow channels 18 having an identical channel shape are disposed in parallel as shown in FIG. 9A, a greater flow channel resistance of each common flow channel 19, which prevents a smooth flow of ink, results in individual communication flow channels 18 located farther from the exit of the common flow channel 19 having greater difficulty in flowing ink. This results in a variance in the amount of discharged ink among the individual communication flow channels 18.

The inkjet head 100 according to this embodiment configured to satisfy Expression (2) can reduce a variance in the amount of discharged ink among the individual communication flow channels 18, enhancing the stability in ink ejection.

A method for calculating the flow channel resistance of each channel will now be described.

In the case of a cuboid flow channel with a width w (m), a height h (m), and a length l (m), and an ink fluid viscosity η (Pa·S), the flow channel resistance R can be calculated from the following expression:

$$\text{flow channel resistance } R=8\eta\cdot l\cdot(h+w)^2/(hw)^3.$$

In the case of a cylindrical flow channel with a diameter d (m), a height l (m), and an ink fluid viscosity η (Pa·S). The flow channel resistance R can be calculated from the following expression:

$$\text{flow channel resistance } R=128\cdot\eta\cdot l/\pi d^4.$$

In the case of any other shape, for example, a taper channel, the taper shape is divided into segmentalized cuboids in the longitudinal direction and the flow channel resistance R can be determined by integration.

The combined resistance Rt of the individual communication flow channels 18 will now be described.

The individual communication flow channels 18 are connected to the common flow channels 19 in parallel with each other, as shown in FIG. 9A. In this case, the combined resistance Rt of the individual communication flow channels 18 connected to the common flow channels 19 can be determined by calculating the reciprocals of the flow channel resistances of the common flow channels 19 and adding up the reciprocals.

In details, in the case of n (=integer of 2 or more) individual communication flow channels 18 connected to the common flow channels 19 in parallel with each other, the combined resistance Rt can be calculated from the following expression:

$$1/Rt=(1/Ri_{(1)})+(1/Ri_{(2)})+\ldots+(1/Ri_{(n)})$$

where the individual communication flow channels 18 have the flow channel resistance of $Ri_{(1)}$, $Ri_{(2)}$, . . . , $Ri_{(n)}$, respectively.

The configuration of the flow channels may be modified, as needed, provided that Expressions (1) and (2) are satisfied.

For example, the common flow channel 19 may be configured such that the flow channel resistance increases toward its exit. An example of this configuration is a common flow channel 19 having a cross-sectional area that decreases toward its exit, as shown in FIG. 9B.

Alternatively, the individual communication flow channels 18 connected to the respective common flow channels 19 at positions closer to the exit of the common flow channel 19 may have greater flow channel resistances toward the exit of the common flow channel 19. An example of this configuration is a configuration of individual communication flow channels 18 the cross-sectional area of which decreases toward the exit of the common flow channel 19, as shown in FIG. 9C.

Figure 9B:
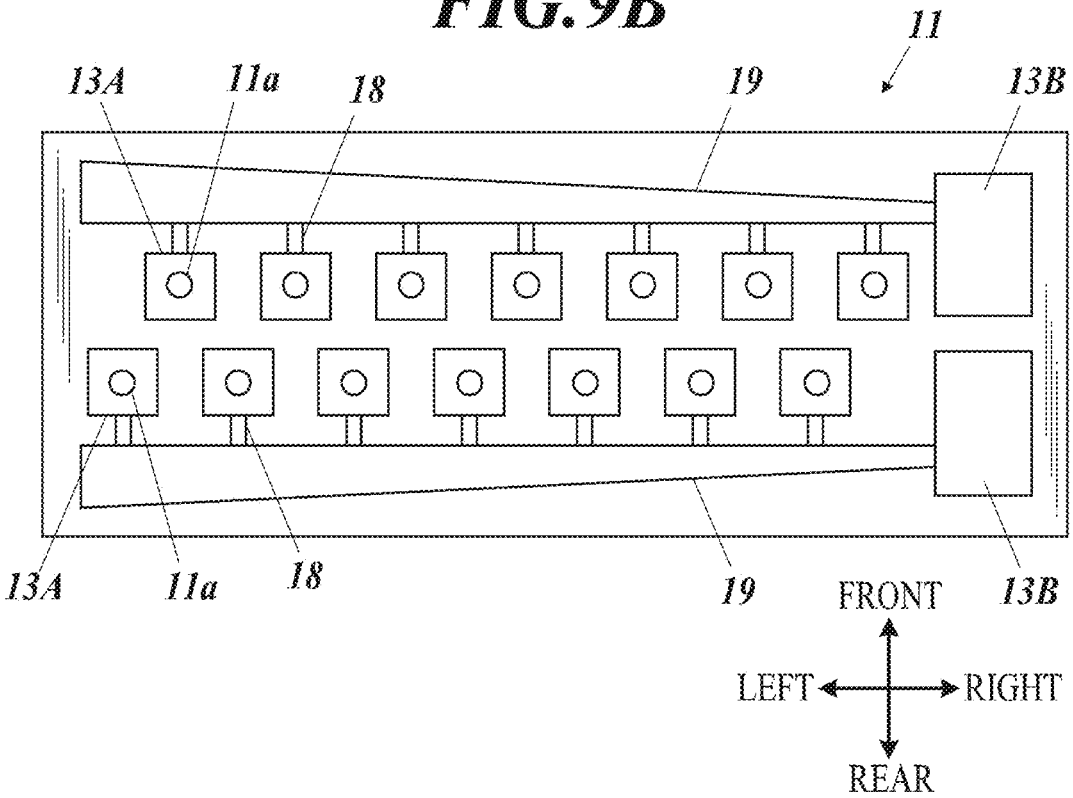
FIG. 9B a plan view of a variation of the nozzle substrate
Figure 9C:
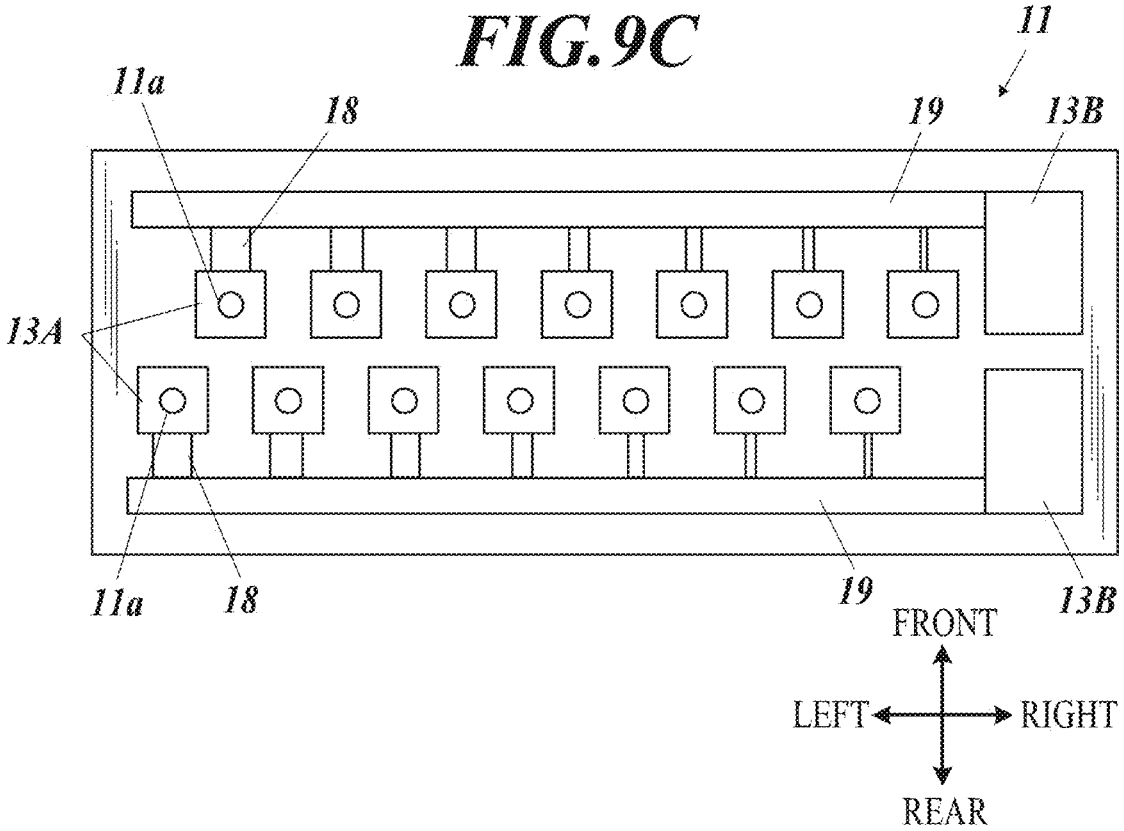
FIG. 9C a plan view of another variation of the nozzle substrate

The configurations shown in FIG. 9B and FIG. 9C facilitate the ink flow in the individual communication flow channels 18 connected at positons farther from the exit of the common flow channel 19, which are more likely to be affected by the flow channel resistance of the common flow channel 19. This configuration can reduce a variance in the amount of discharged ink droplets among the individual communication flow channels 18 due to the influence of the flow channel resistance of the common flow channel 19, and can reduce a variance in ejection performance among the nozzles 11*a*.

Figure 9D:
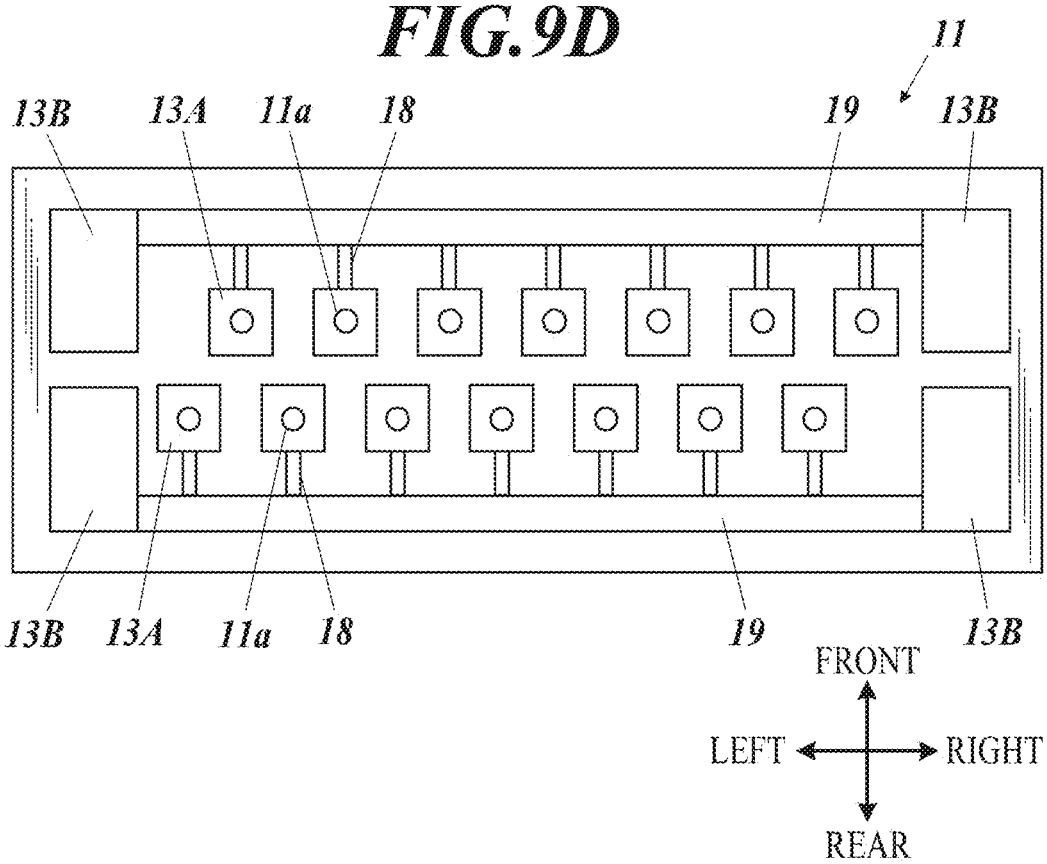
FIG. 9D a plan view of still another variation of the nozzle substrate

Alternatively, the common flow channel 19 may have exits at its two ends, as shown in FIG. 9D. This two-exit configuration can reduce the number of the individual communication flow channels 18 connected at positions remoter from the exits of the common flow channel 19, as shown in FIG. 9B and FIG. 9C, successfully reducing a variance in the amount of discharged ink among the individual communication flow channels 18 and a variance in ejection performance among the nozzles 11*a*.

[Ink Circulator System]

The ink circulator system 8 is an ink feeder to generate a circulatory flow of the inks from the pressure chambers 13A to the respective individual communication flow channels 18 in the inkjet head 100. The ink circulator system 8 includes a feed sub-tank 81, a circulating sub-tank 82, and a main tank 83 (FIG. 10).

The feed sub-tank 81 is filled with ink to be fed to the ink storage 51 in the manifold 5 and connected to a first ink port 53 via an ink flow channel 84.

The circulating sub-tank 82 is filled with ink discharged from the discharge ink chamber 57 in the manifold 5 and connected to the fourth ink port 56 via an ink flow channel 85.

The feed sub-tank 81 and the circulating sub-tank 82 are disposed at different vertical positions (in the direction of gravity) relative to the nozzle surface of the head chip 1 (hereinafter referred to as a "positional reference surface"). This configuration generates a pressure P1 due to a difference in water head between the positional reference surface and the feed sub-tank 81 and generates a pressure P2 due to a difference in water head between the positional reference surface and the circulating sub-tank 82.

The feed sub-tank 81 and the circulating sub-tank 82 are connected to an ink flow channel 86. A pressure applied by a pump 88 can return ink from the circulating sub-tank 82 to the feed sub-tank 81.

The main tank 83 is filled with ink to be fed to the feed sub-tank 81 and connected to the feed sub-tank 81 via an ink flow channel 87. A pressure applied by a pump 89 can feed ink from the main tank 83 to the feed sub-tank 81.

The amount of ink filled in each sub-tank and the vertical (along the gravity) position of each sub-tank may be varied, as needed, to adjust the pressure P1 and pressure P2. A difference between the pressure P1 and the pressure P2 allows ink in the inkjet head 100 to be circulated at a circulating flow rate. This can expel air bubbles generated in the head chip 1 and reduce clogging in a nozzle 11*a* or ejection defects.

The method for controlling the circulatory flow of the ink using a difference in water head has been described as an example of the ink circulator system 8. The configuration may be modified, as needed, provided that it can generate a circulatory flow of the ink.

[Inkjet Head According to Another Embodiment]

The inkjet head 100 according to the embodiment described above is equipped with a head chip 1 of a shear-mode type. The technology of the present invention may be also applied to a head chip 1 of any other type. An inkjet head 100 according to another embodiment will now be described. The inkjet head 100 is equipped with a head chip 1 fabricated by stacking multiple layers in parallel using the micro electro mechanical system (MEMS) technology.

In the following explanation, only the major part of the inkjet head 100 according to another embodiment will be described, and the same configuration as that of this embodiment is given the same reference numerals without redundant explanation.

Figure 11:
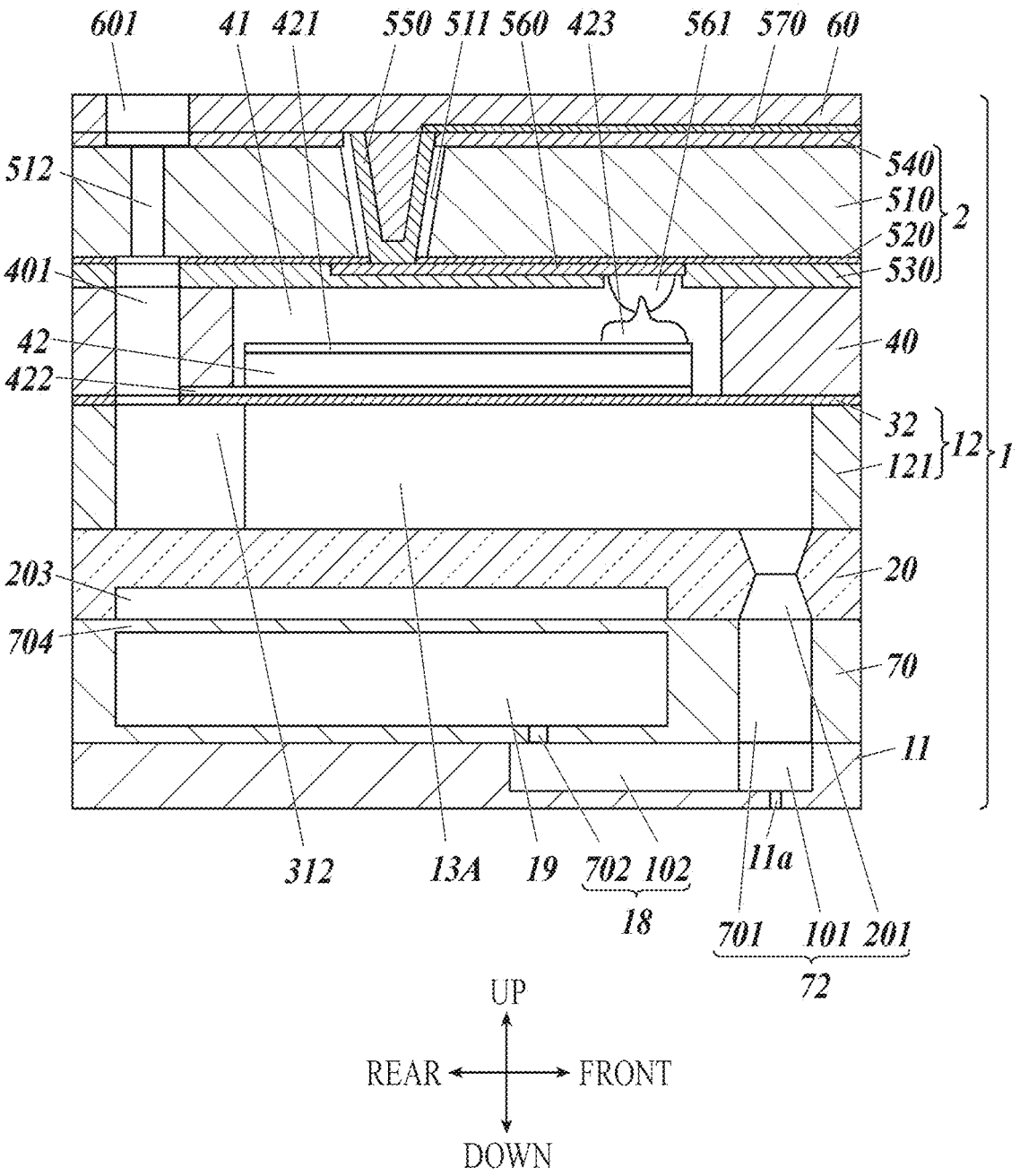
FIG. 11 an enlarged partial cross-sectional view of a head chip according to another embodiment

The head chip 1 is fabricated by stacking and integrating a nozzle substrate 11, a common flow channel substrate 70, an intermediate substrate 20, a pressure chamber substrate 12, a spacer substrate 40, a wiring substrate 2, and a bonding layer 60 in this order from the bottom (see FIG. 11). FIG. 11 is an enlarged partial view of the head chip 1. The head chip 1 includes a plurality of such configurations.

The nozzle substrate 11 has a nozzle 11*a*, a large-diameter section 101, and an individual flow channel 102. The large-diameter section 101 is in communication with the nozzle 11*a* and has a greater diameter than that of the nozzle 11*a*. The individual flow channel 102 branches from the large-diameter section 101 and is used to circulate ink. The nozzle substrate 11 is made of an SOI substrate and processed with high accuracy by anisotropic etching.

The common flow channel substrate 70 is made of, for example, silicon, and has a large-diameter section 701 extending vertically therethrough, a restricting section 702, and a common flow channel 19. Ink streams flowing from the individual flow channel 102 the restricting section 702 merge with each other at the common flow channel 19.

The common flow channel substrate 70 is provided with a damper 704 which faces the top face of the common flow channel 19 and undergoes elastic deformation by pressure to vary the volume of flow channel. The damper 704 is made of, for example, a silicon substrate with a thickness of 1 to 50 μm. An air chamber 203 is disposed on the top face of the damper 704.

The intermediate substrate 20 is made of glass and has a vertically penetrating communication hole 201 and an air chamber 203 at a position corresponding to the top face of the damper 704. In this specification, a flow channel between the pressure chamber 13A and the nozzle 11*a* is referred to as a communication channel 72. In the example shown in FIG. 11, the communication hole 201, the large-diameter section 701, and the large-diameter section 101 are collectively referred to as a communication channel 72.

The pressure chamber substrate 12 includes a pressure chamber layer 121 and a vibrating plate 32. The pressure chamber layer 121 is, for example, a silicon substrate. The pressure chamber layer 121 includes a pressure chamber 13A storing ink to be ejected from the nozzle 11*a*. The pressure chamber layer 121 also has a communication hole 312. The communication hole 312 is in communication with the pressure chamber 13A and extends in the longitudinal direction while penetrating vertically through the pressure chamber layer 121. The vibrating plate 32 is layered on the top face of the pressure chamber layer 121 so as to cover an opening of the pressure chamber 13A, and constitutes an upper wall of the pressure chamber 13A.

The spacer substrate 40 is made of, for example, 42 alloy and functions as a partition layer. The partition layer includes a space 41 accommodating a piezoelectric element 42 functioning as a pressure generator. The piezoelectric element 42 is provided with electrodes 421 and 422 on the upper and lower faces thereof. The electrode 422 on the lower face is connected to the vibrating plate 32. Besides the space 41, the spacer substrate 40 is provided with a through hole 401 penetrating vertically therethrough.

The wiring substrate 2 includes an interposer 510, which is, for example, a silicone substrate. The bottom face of the interposer 510 is covered with two insulating layers 520 and 530, and its top face is covered with an insulating layer 540. The insulating layer 530, which is below the insulating layer 520, is disposed on the top face of the spacer substrate 40.

The interposer 510 includes a through hole 511 penetrating therethrough in the upper direction. The through hole 511 is filled with a through electrode 550. The lower end of the through electrode 550 is connected with one end of the wiring 560 extending horizontally. A stud bump 423 is disposed on the electrode 421 on the top face of the piezoelectric element 42. The stud bump 423 is connected with the other end of the wiring 560 via a soldering portion 561 protruding in the space 41. The top end of the through electrode 550 is connected with a individual wiring 570 extending horizontally.

The interposer 510 has an inlet 512 penetrating in the upper direction and being in communication with the through hole 401 in the spacer substrate 40. The portions, covering the areas around the inlet 512, of the insulating layers 520, 530 and 540 have a greater diameter than that of the inlet 512.

The bonding layer 60 is disposed on the top face of insulating layer 540 on the interposer 510, while covering the individual wiring 570 disposed on the top surface of the wiring substrate 2. Ink is fed from a manifold (not shown) provided above the head chip 1 into the head chip 1 through an ink feeding port 601 provided in the top layer of the head chip 1.

In the head chip 1 in the other embodiment described above, the flow channel including the restricting section 702 and the individual flow channel 102, described above, corresponds to an individual communication flow channel 18 in this embodiment. Even the head chip 1 can achieve the same effect as that of this embodiment by having a channel configuration that meets the above Expressions (1) and (2).

[Technological Effects of the Present Invention]

As described above, the inkjet recording apparatus 200 according to the present invention includes an inkjet head 100 including: a plurality of individual communication flow channels 18 which are provided so as to branch from the respective pressure chambers 13A or from respective communication channels 72 between the pressure chambers 13A and the nozzles 11*a*, and from which ink in the pressure chambers 13A is discharged, and a common flow channel 19 which is connected to the individual communication flow channels 18 and at which ink discharged from the individual communication flow channels 18 merges with each other; and an ink circulator system 8 which generates a circulatory flow of ink from the pressure chambers 13A to the individual communication flow channels 18. The relation between Fn and Fi when ink is ejected from the nozzles 11*a* satisfies the following expression (1), Fn being an ink amount per unit time which is ejected from a nozzle 11*a* that ejects a maximum amount of ink per unit time among all the nozzles 11*a* provided in the inkjet head 100, and Fi being an average ink flow amount per unit time which is discharged from the individual communication flow channels 18 to the common flow channel 19, and the relation between Rc and Rt satisfies the following expression (2), Rc being a flow channel resistance of the common flow channel 19 and Rt being a combined resistance of the individual communication flow channels 18 connected to the common flow channel 19.

$$(Fn/Fi) \leq 10 \qquad \text{Expression (1):}$$

$$(Rc/Rt) \leq 10 \qquad \text{Expression (2):}$$

The channel configuration that meets Expressions (1) and (2) can effectively expel air bubbles or foreign materials in the inkjet head together with ink while maintaining ejection stability of ink.

In the inkjet recording apparatus 200 according to this embodiment, the flow channel resistance of the common flow channel 19 preferably increases toward an exit of the common flow channel 19. This configuration can reduce a variance in the amount of discharged ink droplets among the individual communication flow channels 18, and can reduce a variance in ejection performance among the nozzles 11*a*.

In the inkjet recording apparatus 200 according to this embodiment, among the individual communication flow channels 18 connected to the common flow channel 19, the individual communication flow channel 18 connected to a position closer to an exit of the common flow channel 19 preferably has a larger flow channel resistance. This configuration can reduce a variance in the amount of discharged ink droplets among the individual communication flow channels 18, and can reduce a variance in ejection performance among the nozzles 11*a*.

In the inkjet recording apparatus 200 according to this embodiment, one exit of the common flow channel 19 is preferably provided at each end of an arrangement direction of the nozzles 11*a*.

This configuration can reduce a variance in the amount of discharged ink droplets among the individual communication flow channels 18, and can reduce a variance in ejection performance among the nozzles 11*a*.

The inkjet recording apparatus 200 according to this embodiment preferably includes a damper 11*b* which is provided so as to face an inner surface of the common flow channel 19 and can change a volume of the flow channel by elastic deformation under pressure. The damper 11*b* is preferably formed by a nozzle substrate 11 in which the nozzles 11*a* are formed. This configuration can reduce a variance in pressure in the common flow channel 19 and reduce the influence of a variance in pressure on ejection performance.

In the inkjet recording apparatus 200 according to this embodiment, a manifold 5 which stores ink to be fed to the pressure chambers 13A is preferably provided above the pressure chambers 13A. This configuration can collectively feed ink above the pressure chambers 13A, which leads to a further reduction in size of the inkjet head 100.

[Others]

The embodiments of the present invention described above are provided for illustrative purposes only and should not be construed to limit the scope of the present invention in every respect. The scope of the present invention is defined not by the above explanation but by the scope of the claims and intended to include all the modifications within the meaning and scope equivalent to the scope of the claims.

The inkjet recording apparatus 200 of a one-path drawing type involving the use of a line head has been described. Alternatively, the inkjet recording apparatus 200 may be of a scan type.

In this embodiment, the ink circulator system 8 circulates ink within the head chip 1. Alternatively, the discharge flow channels 13B may discharge ink without circulating it. Alternatively, the discharge flow channels 13B may be configured to provide an option to select circulation or discharge.

The pressure chambers 13A and the discharge flow channel 13B in the head chip 1 are straight and open in the top and bottom faces of the head chip. Alternatively, the pressure chambers 13A and the discharge flow channels 13B may open in the bottom face of the head chip 1, curve upwards, and open in the side face of the head chip 1.

EXAMPLES

The present invention will now be explained in further detail using examples, but these examples should not be construed to limit the scope of the present invention.

Example 1

<Study on Flow Channel Design>

An increased flow amount of ink discharged from the individual communication flow channels 18 to the respective common flow channels 19 per unit time increases a variance in ejection performance among the nozzles 11*a*. This is because an increased flow amount of ink flowing in the individual communication flow channels 18 reduces the ejection energy efficiency, which results in a reduced ejection rate or a reduced amount of an ink droplet, and a variance in the flow amount of circulating ink causes a variance in ejection performance. The inventor has evaluated the expelling performance of air bubbles and stability in ink ejection with the inkjet recording apparatuses 1-1 to 1-5 shown below.

<Preparation of Inkjet Recording Apparatuses 1-1 to 1-5>

The ratio of the amount Fn (L/s) of ink per unit time ejected from the nozzle 11*a* ejecting the largest amount of ink per unit time (seconds) among all the nozzles 11*a* in the inkjet head 100 to the average flow amount Fi (L/s) per unit time of ink discharged from the individual communication flow channels 18 to the respective common flow channels 19 was varied during the ejection of ink from the nozzles 11*a* to evaluate the influence on a variance in ejection performance.

In details, in configurations of inkjet recording apparatuses 200 and inkjet heads 100 shown in FIG. 1 to FIG. 9A, inkjet recording apparatuses 1-1 to 1-5 were prepared, where the channel design and the ink pressure of the inkjet head 100 was adjusted such that Fn (nL/s) and Fi (nL/s) have values shown in Table 1.

In this example, all the nozzles 11*a* were driven at a maximum drive frequency of 40 kHz.

(Drive conditions)

Fluid Viscosity of ink used: 10 (mPa·S)

Amount of droplets of ink ejected: 13 pL

Drive frequency: 40 kHz

Dimensions of common flow channel: 1 mm (height) by 0.2 mm (width) by 72 mm (length)

Flow channel resistance Rc of common flow channel: $1.0\times10^{12}$ (Pa·S/m$^3$)

Dimensions of individual communication flow channel: 40 μm (height) by 40 μm (width) by 100 μm (length)

Combined resistance Rt of individual communication flow channels: $4.9\times10^{10}$ (Pa·S/m$^3$)

The number of individual communication flow channels connected to the common flow channel: 256

Ink pressure in the inkjet head (difference in pressure between IN and OUT ports): 10 kPa The ink pressure within the inkjet head was calculated using a differential pressure between the first ink port 53 (IN port) and the fourth ink port 56 (OUT port).

<Evaluation of Air Bubble Expelling Performance>

To evaluate air bubble expelling performance, same bubbly inks were introduced into the inkjet recording apparatuses 1-1 to 1-5 to put the pressure chambers 13A in a bubbly state. The ink after defoaming was then ejected under the drive conditions described above. In this step, air bubbles were expelled together with ink from the pressure chambers 13A through the individual communication flow channels 18 to evaluate a reduction in defective ink ejection in each nozzle 11*a*.

After the ejection of ink for five minutes under the drive conditions, the nozzles were checked for any defective ejection. A test image for detecting the defective ink ejection of nozzles was recorded on a recording medium and was read to detect whether there is defective ejection.

The number of nozzles having defective ejection was counted and air bubble expelling performance was evaluated as follows. The measurement was performed for the amount of 256 nozzles and the evaluation was performed based on the following criteria:

◎: All the 256 nozzles had no defective ejection

○: One or two nozzles among 256 nozzles had defective ejection

Δ: Three to ten nozzles among 256 nozzles had defective ejection x: Ten or more nozzles among 256 nozzles had defective ejection <Evaluation of Stability in Ink Ejection>

To evaluate the stability in ink ejection, the ejection rate of an ink droplet from each nozzle was measured and the difference between the measured ejection rate and the ejection rate at a circulating flow amount of 0 was calculated. Thereby, a variance in ejection performance among the nozzles 11*a* caused by the circulating flow amount was evaluated.

Although the ejection rate of an ink droplet may be measured by any method, the following method was applied in this embodiment: The flying state of ink droplets released in the air from a nozzle 11*a* was observed with a stroboscope for inkjet droplets observation (JetScope made from MICROJET Corporation) and the ejection rate of an ink droplet was calculated with an inkjet droplet automatic measuring system (JetMeasure made from MICROJET Corporation).

This method can adjust the light emitting timing (delay timing) of the strobe light source without modification of the drive conditions. For example, the coordinates (X1, Y1) of an ink droplet on the observation screen at a delay time t=t1 and the coordinates (X2, Y2) of the ink droplet on the observation screen at a delay time t=t2 can be used to determine the ejection rate V using the following Expression (A1).

[Numerical Expression 1]

$$V = \frac{\sqrt{(X2 - X1)^2 + (Y2 - Y1)^2}}{t2 - t1} \quad \text{Expression (A1)}$$

The differences between ink ejection rates of the 256 nozzles were calculated and, with the average value as a reference, a variance in the ink ejection rates was used to evaluate the stability in ink ejection in accordance with the following criteria:

◎: Variance of differences between ink ejection rates among all the nozzles: ±0.5% or less ○: Variance of differences between ink ejection rates among all the nozzles: ±1.0% or less Δ: Variance of differences between ink ejection rates among all the nozzles: ±2.0% or less x: Variance of differences between ink ejection rates among all the nozzles: more than ±2.0%

TABLE I

| | | | | EVALUATION | |
|---|---|---|---|---|---|
| NUMBER | Fn [nL/s] | Fi [nL/s] | Fn/Fi | AIR BUBBLE EXPELLING PERFORMANCE | EJECTION STABILITY |
| 1-1 | 520.0 | 5.2 | 100.0 | x | ◎ |
| 1-2 | 520.0 | 26.0 | 20.0 | Δ | ○ |
| 1-3 | 520.0 | 52.0 | 10.0 | ○ | Δ |
| 1-4 | 520.0 | 104.0 | 5.0 | ○ | Δ |
| 1-5 | 520.0 | 520.0 | 1.0 | ◎ | x |

Table 1 demonstrates that a ratio Fn/Fi of 10 or less leads to an improvement in air bubble expelling performance, but a reduction in stability of ink ejection.

Example 2

<Preparation of inkjet recording apparatuses 2-1 to 2-14>

Inkjet recording apparatuses 2-1 to 2-14 were prepared by modifying the shapes of the common flow channels 19 and the individual communication flow channels 18 in the inkjet recording apparatuses 1-3 and 1-5 used in Example 1 such that the flow channel resistance Rc of each common flow channel 19 and the combined resistance Rt of the individual communication flow channels 18 connected to the respective common flow channels 19 have values shown in Table 2. The air bubble expelling performance and stability in ink ejection were evaluated. The evaluation of them was performed in a similar method to that of example 1. Fi was adjusted through the adjustment of the ink pressure in the inkjet head (a difference in pressure between IN and OUT ports).

TABLE II

| | INK FLOW AMOUNT | | | FLOW CHANNEL RESISTANCE | | | EVALUATION | | |
|---|---|---|---|---|---|---|---|---|---|
| NUMBER | Fn [nL/s] | Fi [nL/s] | Fn/Fi | Rc [Pa · s/m³] | Rt [Pa · s/m³] | Rc/Rt | *1 | INK EJECTION STABILITY | NOTES |
| 2-1 | 520.0 | 52.0 | 10.0 | $1.037 \times 10^{12}$ | $3.16 \times 10^{10}$ | 32.8 | ○ | X | COMPARATIVE |
| 2-2 | 520.0 | 52.0 | 10.0 | $1.037 \times 10^{12}$ | $4.88 \times 10^{10}$ | 21.2 | ○ | Δ | COMPARATIVE |
| 2-3 | 520.0 | 52.0 | 10.0 | $1.037 \times 10^{12}$ | $8.86 \times 10^{10}$ | 11.7 | ○ | Δ | COMPARATIVE |
| 2-4 | 520.0 | 52.0 | 10.0 | $1.037 \times 10^{12}$ | $1.04 \times 10^{11}$ | 10.0 | ○ | ○ | INVENTIVE |
| 2-5 | 520.0 | 52.0 | 10.0 | $1.037 \times 10^{12}$ | $1.54 \times 10^{11}$ | 6.7 | ○ | ○ | INVENTIVE |
| 2-6 | 520.0 | 52.0 | 10.0 | $1.037 \times 10^{12}$ | $3.62 \times 10^{11}$ | 2.9 | ○ | ○ | INVENTIVE |
| 2-7 | 520.0 | 52.0 | 10.0 | $1.037 \times 10^{12}$ | $7.81 \times 10^{11}$ | 1.3 | ○ | ◎ | INVENTIVE |
| 2-8 | 520.0 | 520.0 | 1.0 | $1.037 \times 10^{12}$ | $3.16 \times 10^{10}$ | 32.8 | ◎ | X | COMPARATIVE |
| 2-9 | 520.0 | 520.0 | 1.0 | $1.037 \times 10^{12}$ | $4.88 \times 10^{10}$ | 21.2 | ◎ | X | COMPARATIVE |
| 2-10 | 520.0 | 520.0 | 1.0 | $1.037 \times 10^{12}$ | $8.86 \times 10^{10}$ | 11.7 | ◎ | Δ | COMPARATIVE |
| 2-11 | 520.0 | 520.0 | 1.0 | $1.037 \times 10^{12}$ | $1.04 \times 10^{11}$ | 10.0 | ◎ | ○ | INVENTIVE |
| 2-12 | 520.0 | 520.0 | 1.0 | $1.037 \times 10^{12}$ | $1.54 \times 10^{11}$ | 6.7 | ◎ | ○ | INVENTIVE |
| 2-13 | 520.0 | 520.0 | 1.0 | $1.037 \times 10^{12}$ | $3.62 \times 10^{11}$ | 2.9 | ◎ | ○ | INVENTIVE |
| 2-14 | 520.0 | 520.0 | 1.0 | $1.037 \times 10^{12}$ | $7.81 \times 10^{11}$ | 1.3 | ◎ | ◎ | INVENTIVE |

*1: AIR BUBBLE EXPELLING PERFORMANCE

Table 2 demonstrates that the ratio Fn/Fi of 10 or less and the ratio Rc/Rt of 10 or less can effectively expel air bubbles in the inkjet head together with ink while maintaining the stability in ink ejection.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The present invention can be used for inkjet recording apparatuses.

EXPLANATION OF REFERENCE NUMERALS

1 head chip
5 manifold
8 ink circulator system (ink feeder)
11 nozzle substrate
11*a* nozzle
11*b* dumper
13A pressure chamber
15 partition (pressure generator)
18 individual communication flow channel
19 common flow channel
72 communication channel
100 inkjet head
200 inkjet recording apparatus

The invention claimed is:

1. An inkjet recording apparatus comprising:

an inkjet head including:

a plurality of nozzles which eject ink, a plurality of pressure chambers which are provided in communication with the respective nozzles and store ink to be ejected from the nozzles, a plurality of pressure generators which are provided so as to correspond to the respective pressure chambers and apply pressure to ink in the pressure chambers, a plurality of individual communication flow channels which are provided so as to branch from the respective pressure chambers or from respective communication channels between the pressure chambers and the nozzles, and from which ink in the pressure chambers is discharged, and a common flow channel which is connected to the individual communication flow channels and at which ink discharged from the individual communication flow channels merges with each other; and an ink feeder which generates a circulatory flow of ink from the pressure chambers to the individual communication flow channels, wherein a relation between Fn and Fi when ink is ejected from the nozzles satisfies the following expression (1), Fn being an ink amount per unit time which is ejected from a nozzle that ejects a maximum amount of ink per unit time among all the nozzles provided in the inkjet head, and Fi being an average ink flow amount per unit time which is discharged from the individual communication flow channels to the common flow channel, and a relation between Rc and Rt satisfies the following expression (2), Rc being a flow channel resistance of the common flow channel and Rt being a combined resistance of the individual communication flow channels connected to the common flow channel, wherein, among the individual communication flow channels connected to the common flow channel, the individual communication flow channel connected to a position closer to an exit of the common flow channel has a larger flow channel resistance $$(Fn/Fi) \leq 10 \qquad \text{Expression (1)}$$

$$(Rc/Rt) \leq 10 \qquad \text{Expression (2).}$$

2. The inkjet recording apparatus according to claim 1, wherein the flow channel resistance of the common flow channel increases toward an exit of the common flow channel.

3. The inkjet recording apparatus according to claim 1, wherein one exit of the common flow channel is provided at each end of an arrangement direction of the nozzles.

4. The inkjet recording apparatus according to claim 1, comprising a damper which is provided so as to face an inner surface of the common flow channel and changes a volume of the flow channel by elastic deformation under pressure.

5. The inkjet recording apparatus according to claim 4, wherein the damper is formed by a nozzle substrate in which the nozzles are formed.

6. The inkjet recording apparatus according to claim 1, wherein a manifold which stores ink to be fed to the pressure chambers is provided above the pressure chambers.

* * * * *